United States Patent [19]

Johnson et al.

[11] 3,985,004

[45] Oct. 12, 1976

[54] KNITTED BRIEFS

[75] Inventors: Martin Robert Johnson, Broughton Astley; Arthur John Hood, Hinckley, both of England

[73] Assignee: Ridley, Spriggs and Johnson Limited, Hinckley, England

[22] Filed: Dec. 5, 1974

[21] Appl. No.: 529,912

[52] U.S. Cl. ..... 66/177; 2/402

[51] Int. Cl.[2] ..... A41B 9/02; A41B 9/04

[58] Field of Search ..... 60/177, 178 R, 176, 60/175; 2/402

[56] References Cited

UNITED STATES PATENTS

| | | | |
|---|---|---|---|
| 570,696 | 11/1896 | Brown | 66/176 |
| 1,045,635 | 11/1912 | Swinglehurst | 66/176 |
| 1,179,045 | 4/1916 | Scott | 66/176 |
| 2,062,594 | 12/1936 | McNair | 66/177 UX |
| 2,285,012 | 6/1942 | Burkey | 66/177 |
| 2,575,701 | 11/1951 | Artzt | 2/402 |
| 2,809,510 | 10/1957 | West | 66/177 |
| 2,847,842 | 8/1958 | Almen | 66/177 |
| 3,010,302 | 11/1961 | Morgan | 66/177 |
| 3,109,301 | 11/1963 | Garrou et al. | 66/177 |
| 3,178,911 | 4/1965 | Faust | 66/177 |
| 3,375,530 | 4/1968 | Matthews et al. | 66/177 |
| 3,561,000 | 2/1971 | Wignall | 66/176 |
| 3,605,452 | 9/1971 | Carter et al. | 66/176 |
| 3,673,821 | 7/1972 | Johnson | 66/177 |
| 3,760,611 | 9/1973 | Duckworth | 66/177 |
| 3,772,899 | 11/1973 | Novi | 66/176 |

FOREIGN PATENTS OR APPLICATIONS

| | | | |
|---|---|---|---|
| 1,941,322 | 5/1971 | Germany | 66/176 |
| 6,608,880 | 12/1967 | Netherlands | 66/177 |
| 792,873 | 4/1958 | United Kingdom | 66/178 R |

*Primary Examiner*—Mervin Stein
*Assistant Examiner*—A. M. Falik
*Attorney, Agent, or Firm*—Edelson and Udell

[57] ABSTRACT

A method of producing a knitted brief blank of flat form. First, a preliminary tubular blank including a comparatively narrow portion of crotch fabric is produced by seamless knitting. Then this tubular blank is slit and opened out flat into a final brief blank. The preliminary tubular blank in one form comprises two circular knitted tubular portions extending relatively at an angle and connected by an interposed elbow-like pouch formed by reciprocatory knitting on to the point of which is knitted a comparatively narrow selvedged loop of crotch fabric.

Alternatively, the preliminary tubular blank may be wholly produced by circular knitting and comprise aligned opposite end portions and an intervening waisted portion of reduced diameter constituting narrowed crotch fabric.

7 Claims, 4 Drawing Figures

KNITTED BRIEFS

This invention relates to the manufacture of knitted briefs.

By a brief is meant a garment comprising a body portion adapted to cover the lower part of the wearer's trunk from the waist downwards to and beneath the crotch, and having therein leg openings at respectively opposite sides of the crotch portion which latter, of course, closes the garment at its lower end.

A flat blank capable of being seamed to produce a knitted brief conventionally comprises spaced front and back sections with inwardly and oppositely inclined edges defining respectively the fronts and backs of the leg openings in said brief, and an intervening substantially narrower crotch portion.

In former times it was the custom to produce a knitted brief blank of the general shape just described in the form of a full-fashioned selvedged flat knitted article which was wale-fashioned by transference of loops on a fully-fashioned hosiery machine. But as in the course of time these machines became, for all practical intents and purposes, obsolete, the technique was developed of producing brief blanks by appropriately cutting and opening out lengths of tubular fabric produced on a circular seamless hose machine of an appropriate diameter. However, this prior method has the disadvantage that a significant proportion, say, a fifth, of the seamless tubular fabric has to be cut to waste.

The object of the present invention, therefore, is to provide expeditious and economical methods of producing, in a seamless manner upon a circular seamless hose knitting machine, fashioned preliminary blanks which are initially in tubular form but are adapted to be simply slit, without the necessity to cut away any parts thereof to waste, and opened out to provide final knitted brief blanks of the desired shape.

Thus, according to this invention there is provided a method of producing a knitted brief blank of a flat form consisting of spaced front and back sections of an ultimate brief with inwardly and oppositely inclined edges defining respectively the fronts and backs of the leg openings in said brief, and an intervening substantially narrowed crotch portion, the method comprising the steps of (a) first knitting on a circular seamless hose machine, either partly by rotary and partly by reciprocatory knitting, or wholly by rotary knitting, a preliminary seamless tubular blank of a width half that of the ultimate brief required, said blank comprising two opposite end portions each of the maximum width of the tube, and an intermediate substantially narrower portion of crotch fabric and (b) then appropriately slitting the said preliminary seamless tubular blank along a straight line or lines and opening it out into a final brief blank of the aforementioned flat form.

Figure 1:
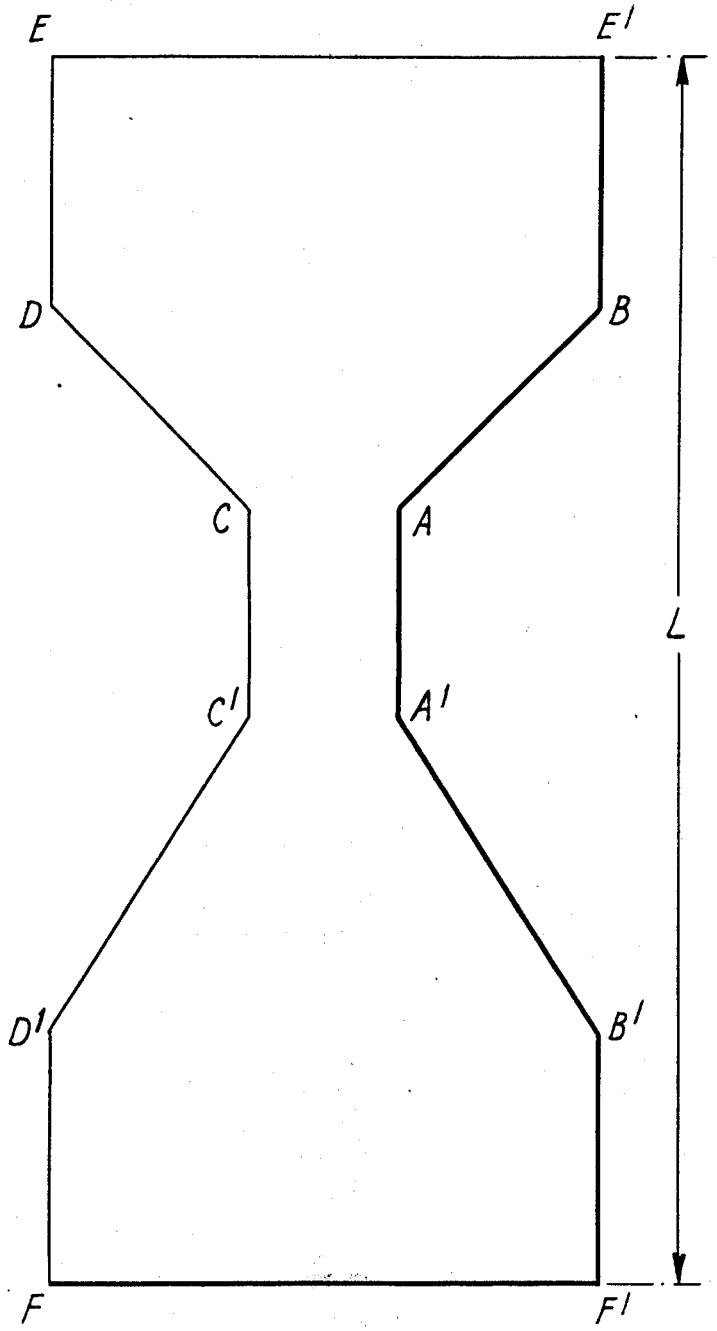
FIG. 1 PRIOR ART

One possible form of a fashioned preliminary seamless tubular blank produced in accordance with the invention is one which is knitted partly by rotary and partly by reciprocatory knitting and comprises two circularly knitted tubular portions extending relatively at an angle and connected by an interposed heel or elbow-like pouch on to the point of which is integrally knitted a comparatively narrow selvedged loop of uniform width destined to provide crotch fabric when the preliminary tubular blank is eventually slit and opened out into a final flat form like that illustrated in FIG. 1.

When the narrow crotch fabric is formed in a pouched blank as just described, said fabric is knitted on a proportion only of the circular set of needles of the seamless hose machine. For example, such crotch fabric may be knitted on a third only of these needles so that it is only about one third of the overalll width of the final brief blank.

Another possible form of preliminary seamless tubular blank produced in accordance with this invention is one which, instead of being pouched, is waisted, i.e. has between its opposite ends a portion which, although knitted on all or nearly all the needles of the circular set, is nevertheless of substantially reduced diameter at a location between its opposite ends, the coursewise constriction constituting this waisting being produced by the use of contrasting yarns of respectively different types or/and deniers in conjunction with stitch variations. Such stitch variations may, if desired, include changes in stitch quality, i.e. length.

Thus, the waisting, i.e. coursewise constriction, of the preliminary blank may, according to this invention, be in part achieved by knitting on all or nearly all the needles of the circular set at one or more feeds and on spaced needles only at the other feed or feeds - floats being formed over the intervening non-knitting needles.

Figure 3:
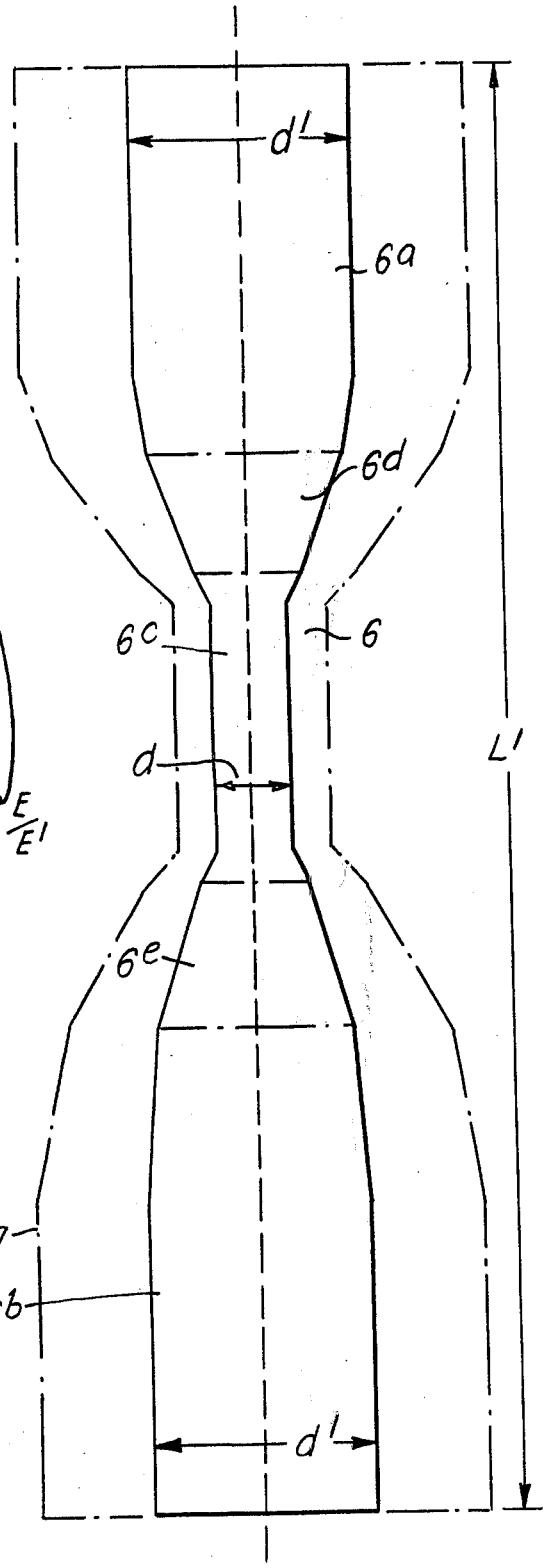
Figure 2:
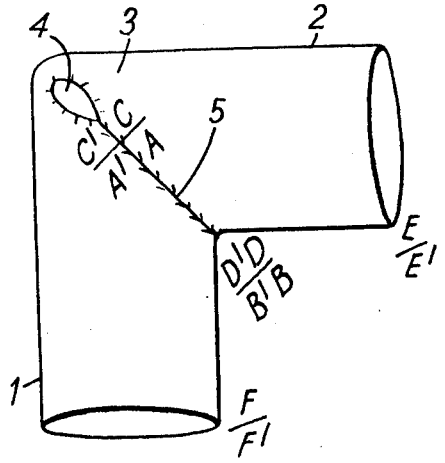
Figure 4:
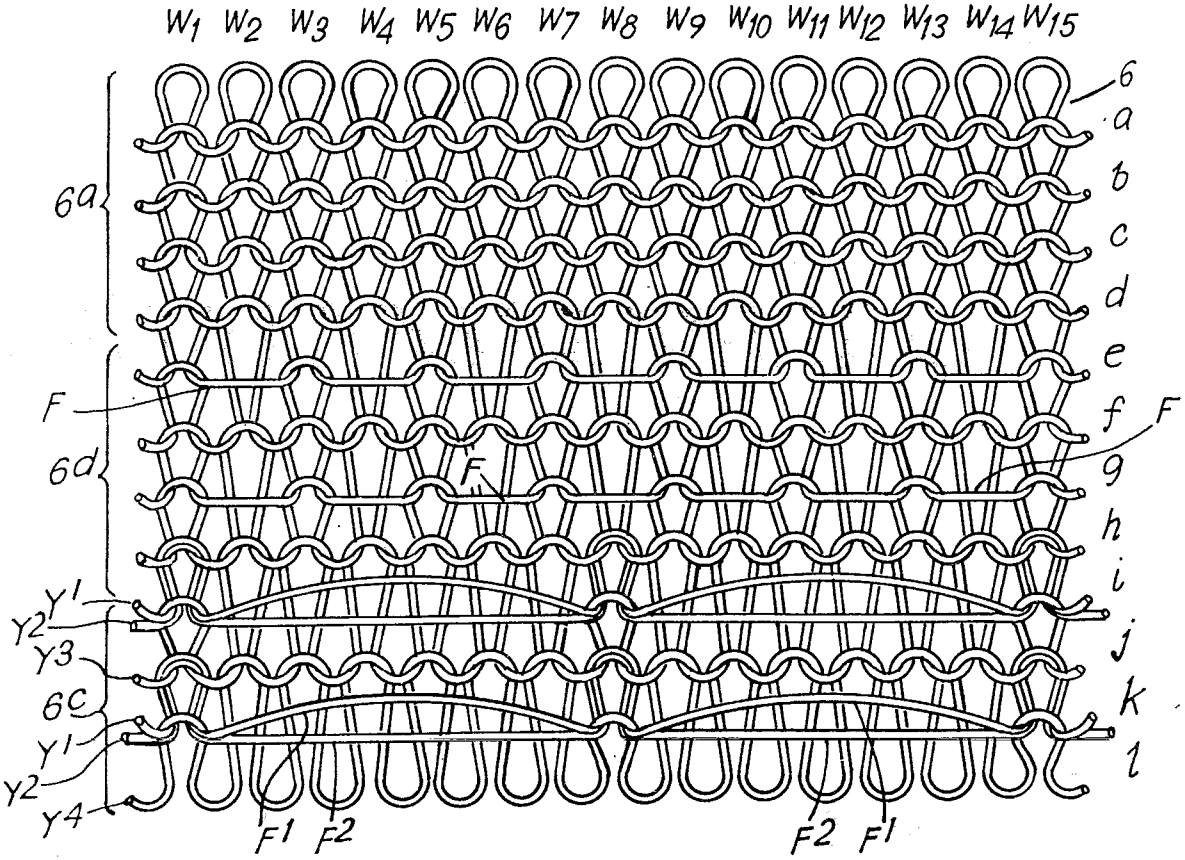

In order that the present invention may be more clearly understood and readily carried into practical effect, a conventional flat knitted brief blank and specific examples of preliminary seamless tubular blanks produced in accordance with the present invention will now be described with reference to the accompanying drawings, wherein, FIG. 1 illustrates said conventional flat knitted brief blank, FIG. 2 is a perspective view, from the side, of a pouched form of preliminary tubular blank, FIG. 3 illustrates a waisted preliminary tubular blank laid out in a flat condition, and also shows, in chain lines the final shape of the brief blank produced by slitting from end to end and opening out the said preliminary tubular blank, and FIG. 4 is a loop structure diagram showing, to a greatly magnified scale, adjacent portions of the knitted fabric in the waisted tubular blank depicted in FIG. 3, as will be hereinafter described.

A conventional and well known flat blank capable of being seamed to produce a knitted brief will first be described with reference to FIG. 1. A flat blank capable of being seamed to produce a knitted brief is illustrated in FIG. 1 of the accompanying drawings. As will be seen, the rectangular portion B, D, E, $E^1$ together with the immediately adjoining trapezium-shaped portion A, B, D, C of this blank are destined to constitute the front section of the ultimate brief, the inwardly and oppositely inclined edges AB and CD defining fronts of the leg openings thereof. Similarly, the rectangular portion $B^1$, $D^1$, F, $F^1$, combined with the adjoining trapezium-shaped portion $A^1$, $B^1$, $D^1$, $C^1$ of the blank provide the back section of the ultimate brief, the inwardly and oppositely inclined edges $A^1$ $B^1$ and $C^1$ $D^1$ defining the backs of the leg openings. The front and the back sections just described are spaced apart with an intervening rectangular and comparatively narrow crotch portion A, $A^1$, $C^1$, C interposed between them. A point to note with regard to this brief blank is that the inclined edge $A^1$ $B^1$ is a little longer than the edge AB, and the inclined edge $C^1$ $D^1$ is commensurately longer than the edge CD; this is so that the back section shall be larger than the front section, thereby providing adequate room in the back of the ultimate brief produced by suitably folding and seaming the blank.

To form a brief from the initially flat one-piece blank described above the blank is folded in half along a transverse line near to $C^1$ $A^1$ of the crotch portion A, $A^1$, $C^1$, C whereupon ED is seamed to $FD^1$ and $E^1B$ is seamed to $F^1$ $B^1$ the crotch portion being left in the form of a loop to close the nether region of the garment between the leg openings.

Referring now to FIG. 2, it will be seen that the preliminary pouched tubular blank therein depicted comprises a first circularly knitted tubular portion 1, a second circularly knitted tubular portion 2 and an interposed heel or elbow-like pouch 3. Knitted integrally on to the point of the pouch 3 is a uniformly wide selvedged loop of crotch fabric 4. At 5 is represented the suture line between adjoining narrowed and widened portions of the pouch 3.

The method of making the preliminary seamless tubular blank illustrated in FIG. 2 on a circular hose knitting machine equipped with a needle cylinder reciprocating mechanism and narrowing and widening pickers comprises the successive steps of:

i. knitting by rotary motion of the cylinder on all or nearly all of the set of needles therein the first tubular portion 1 of fabric, ii. then forming the narrowed portion of the heel or elbow-like pouch 3 by reciprocatory knitting on a proportion, e.g. two thirds, of the set of needles by actuation of narrowing pickers which function to take this proportion of the needles progressively out of action, iii. with the pickers withdrawn continuing reciprocatory knitting on the remainder, e.g. one third, of the said needles suchwise as to produce the uniformly wide selvedged loop of crotch fabric 4, iv. next forming the widened portion of the pouch 3 to complete the same by reciprocatory knitting and progressive restoration into action of the larger proportion of the needles of the set, and v. knitting on to and in continuation of the pouch 3 by rotary knitting on all or nearly all the needles the second tubular portion 2 of fabric.

The preliminary seamless tubular blank so made is converted into a final brief blank by slitting it first along the straight suture line 5 between the adjoining narrowed and widened portions of the pouch 3, and then along the two right-angularly disposed $E/E^1 - D/B$ and $D^1/B^1 - F/F^1$. When this blank is opened out to a flat condition it will be found that the selvedged loop of crotch fabric 4 corresponds to the portion of narrowed fabric $ACC^1A^1$ in FIG. 1.

For the information of the reader, the original conception of what form a preliminary knitted tubular blank should take to enable a final blank like that illustrated in FIG. 1 to be derived therefrom by simply slitting it and opening it out, a fashioned flat knitted blank of the said required form was first made and then seamed together as follows (see FIG. 1):

The edge AB was seamed to the edge $A^1B^1$ — accommodating the extra length of the latter; the edge CD was seamed to the edge $C^1D^1$ — accommodating the extra length of $C^1D^1$; $EDD^1F$ was seamed to $E^1BB^1F^1$. The result was a preliminary pouched tubular blank like that illustrated in FIG. 2. To test this conception, the blank of FIG. 2 was then converted back to its FIG. 1 condition by slitting through $C^1C - D^1D - B^1B - A^1A$ and through $FF^1 - D^1B^1 - DB - EE^1$.

By using a Bently FCM circular knitting machine it would be possible to expedite production of the improved brief blanks produced by the method described with reference to FIG. 2 by knitting portions of tubular fabric each formed with a pair of opposite-handed pouches having knitted on to them integral uniformly wide loops of crotch fabric.

The waisted form of preliminary tubular blank illustrated in FIG. 3 is produced wholly by circular knitting and, as laid out flat, has approximately the peripheral shape of an hour-glass. The said preliminary blank, generally designated 6, comprises two opposite end portions 6*a* and 6*b*, a waisted portion 6*c* located centrally between these end portions and two intermediate portions 6*d* and 6*e* between the opposite ends of the waisted portion 6*c* and the two end portions 6*a* and 6*b* respectively. The limits of the intermediate portions 6*d* and 6*e*, lengthwise of the preliminary tubular blank 6 are indicated by the pairs of horizontal chain lines. The diameter *d* of the waisted portion 6*c* which is to constitute the comparatively narrow crotch of the ultimate brief blank is ideally only one third of the maximum diameter *d*1 of the end portions 6*a* and 6*b*.

As previously mentioned, the waisted portion 6*c* is, in this example, achieved by forming in the tube 6 at a location centrally between its opposite ends a coursewise constriction produced by the use of contrasting yarns of respectively different types or/and deniers in conjunction with stitch variations including, if desired, changes is stitch quality.

It is found that a particularly good effect can be achieved by incorporating cotton yarn into evenly distributed courses of the waisted portion of a preliminary tubular blank. Such a cotton yarn may, in a six-feed machine, be fed in at, say, the third and the sixth feeds, or even at each alternate one of the feeds.

In any event, an appropriate change in the denier of the yarn or yarns knitted to produce the crotch portion (as compared with the denier of the yarn or yarns in the remaining portions of a preliminary tubular blank) will assist in the necessary coursewise restriction of the blank.

It is also found to be advantageous when producing the portions of the tubular blank immediately adjoining the waisted portion which provides the crotch, to cause all or nearly all the needles of the set to knit alternate courses and alternate needles only to knit the intervening courses.

In the particular example now being described, FIG. 4 shows, in a composite fashion, and on a magnified scale, the different loop structures in the end, i.e. body, portion 6*a*, in the waisted portion 6*c* and in the intermediate portion 6*d* of the preliminary tubular blank 6, it being understood that the loop structures in the portions 6*b* and 6*e* of the said blank are the same as those in the portions 6*a* and 6*d* respectively. The back of the fabric is shown, and it is assumed that the preliminary blank in this case is produced either on a crepe or on a 4-feed seamless hose machine. Merely for convenience, only four courses of each contrasting loop structure are depicted. First, let it be assumed that knitting takes place on a twin-feed machine. Then, in the end of body portion 6*a*, which is shown as being wholly plain knit (without, however, any limitation in this respect), the alternate courses *a* and *c* are knitted of 70 denier S-twist crepe yarns whilst the intervening courses *b* and *d* are knitted of 70 denier Z-twist crepe yarns. Similarly, in the intermediate portion 6*d*, each of the alternate courses *e* and *g* is also knitted of a 70 denier S-twist yarn and each of the intervening courses *f* and *h* is knitted of a 70 denier Z-twist yarn, but whereas each of such courses *e* and *g* is knitted on alternate needles only so that there are knitted loops in wales $W_1$, $W_3$, $W_5$, $W_7$, $W_9$, $W_{11}$, $W_{13}$ and $W_{15}$ and floats as at F across wales $W_2$, $W_4$, $W_6$, $W_8$, $W_{10}$, $W_{12}$ and $W_{14}$, each of the courses *f* and *h* is knitted on all (or nearly all) the needles.

The waisted portion 6*c* which is to provide the crotch is reinforced by virtue of the alternate courses *i* and *k* thereof each being composed of two yarns $Y^1$ and $Y^2$, whilst the intervening courses *j* and *l* are knitted of any suitable yarns $Y^3$ and $Y^4$ adapted to balance the crotch fabric. Thus, in this particular example, each of the yarns $Y^1$ is a 50's cotton, each of the yarns $Y^2$ is a 20 denier Lycra covered with 20 denier nylon, and each of the yarns $Y^3$ and $Y^4$ is a 2/30's nylon. Moreover, in each of the courses *i* and *k*, the two yarns $Y^1$ and $Y^2$ are knitted together in widely spaced wales only, e.g. in every seventh wale, and are elsewhere floated at $F^1$ and $F^2$ across the intervening wales: thus, the floats in this case are relatively long ones. In the particular illustrated example, the yarns $Y^1$ and $Y^2$ are knitted in wales $W_1$, $W_8$ and $W_{15}$ and floated across wales $W_2 - W_7$ and $W_9 - W_{14}$.

Assume now that a fabric of the same construction as that shown in FIG. 4, with its three adjoining loop structures is knitted on a 4-feed seamless hose machine. In such a case a 70 denier S-twist crepe yarn may be knitted in each of courses *a*, *b*, *e*, *f* and *j* and a 70 denier Z-twist crepe yarn in each of courses *c*, *d*, *g*, *h* and *l*, whilst two yarns $Y^1$ and $Y^2$ are as before knitted in each of courses *i* and *k*. Thus, in this variation, there is no need to withdraw the 70 denier S- and Z-twist crepe yarns from the feeds knitting courses *j* and *l* and replace them by balanced yarns, e.g. 2/30's nylon.

For simplicity in FIG. 4 all the knitted loops are vertically disposed whereas, of course, loops knitted in S-twist and Z-twist crepe yarns should, strictly, be shown inclined to the vertical in respectively opposite directions.

All that is necessary to convert the preliminary tubular blank 6 to a final brief blank is toslit it walewise from end to end, that is to say along a single straight line, and to open it out to the chain-line form 7 indicated in FIG. 3. The precise line along which the preliminary tubular blank 6 is to be slit may conveniently be marked by either leaving a few successive needles out of the circular set on which the said blank is knitted or retracting a few of these needles to non-knit positions. In any case, the hereinbefore phrase "knitting by rotary motion on all or nearly all of the set of needles" is so worded to take care of the fact that a few of the needles may be withdrawn from knitting to demarcate the straight line of slitting.

It is also to be noted that in comparing a tubularly knitted waisted preliminary blank with a corresponding initially fashioned flat knitted blank, each of the two being designed to produce a brief of approximately the same size, it will be found that the length of the tubular blank somewhat exceeds the length of the flat knitted blank. Thus, comparing FIG. 3 with FIG. 1, the length $L^1$ exceeds the length L.

The invention includes within its scope a knitted brief made up from a blank produced in either of the ways hereinbefore described.

We claim:

1. A method of producing a knitted brief blank of a flat form consisting of spaced front and back sections of an ultimate brief with inwardly and oppositely inclined edges defining respectively the fronts and backs of the leg openings in said brief, and an intervening substantially narrower crotch portion, said method comprising the steps of (a) first knitting a preliminary seamless tubular blank of a width half that of the ultimate brief required, said blank shaped walewise in a generally hour-glass configuration including two opposite end portions each of the maximum width of the tube and an intermediate substantially narrower portion of crotch fabric and (b) then slitting and the said preliminary seamless tubular blank along a straight line and opening it out into a final brief blank of the aforementioned flat form.

2. A method of producing a knitted brief blank of the shape comprising, in flat form, a first rectangular portion and an immediately adjoining first trapezium-shaped portion destined together to constitute the front section of an ultimate brief; a second rectangular portion combined with a second trapezium-shaped portion to provide the back section of said ultimate brief, the inwardly and oppositely inclined edges on the first and second trapezium-shaped portions defining respectively the fronts and the backs of the leg openings of the ultimate brief; and, between the two trapezium-shaped portions, an intervening rectangular and compartively narrow crotch portion, the inclined edges of the second trapezium-shaped portion being longer than the corresponding edges of the first trapezium-shaped portion, said method comprising the steps of (a) first producing partly by circular and partly by to and fro knitting, a preliminary seamless tubular blank comprising two circularly knitted tubular portions extending relatively at an angle and connected by an interposed elbow-like pouch on to the point of which is integrally knitted a comparatively narrow selvedged loop of uniform width destined to provide crotch fabric and (b) then slitting and opening out the said preliminary seamless tubular blank into a final flat blank of the hereinbefore defined shape.

3. A method according to claim 2, which includes the steps of:

i. circularly knitting a first tubular portion of fabric,
ii. then forming, by reciprocatory knitting and by progressively reducing the number of knitted loops in the courses the narrowed portion of a pouch,
iii. next producing, by a continuation of the reciprocatory knitting a comparatively narrow but uniformly wide selvedged loop of crotch fabric,
iv. forming, still by reciprocatory knitting, the widened portion of said pouch by progressively increasing the number of knitted loops in the courses, and
v. knitting on to and in continuation of the pouch by circular knitting a second tubular portion of fabric.

4. A method of producing a knitted brief blank of a flat form consisting of spaced front and back sections of an ultimate brief with inwardly and oppositely inclined edges defining respectively the fronts and backs of the leg openings of such brief and an intervening substantially narrower crotch portion, said method comprising the steps of (a) first producing, wholly by circular knitting, a preliminary seamless tubular blank of a width half that of the ultimate brief required, said blank shaped walewise in a generally hour-glass configuration comprising aligned opposite end portions each of the maximum width of the tube and, between said opposite end portion, a waisted portion of substantially reduced diameter to form a crotch, the coursewise constriction constituting the waisting being formed by incorporation into the tubular blank contrasting yarns of respectively different types and deniers in conjunction with stitch variations and (b) then slitting the said preliminary seamless tubular blank walewise, i.e. along a single straight line from end to end and opening it out into a final brief blank of the aforementioned flat form.

5. A method according to claim 4, wherein the waisting of the portion of the preliminary seamless tubular blank between its ends to produce a narrowed crotch is in part achieved by knitting loops in successive needle wales in each of spaced courses and in widely spaced needle wales only in the intervening courses of the crotch fabric so that relatively long floats of yarn extend across those needle wales of said intervening courses devoid of knitted loops.

6. A preliminary seamless knitted tubular blank shaped walewise in a generally hour-glass configuration capable of being slit straight from end to end walewise and of being thereupon opened out into a final brief blank of flat form, said tubular blank being of half the width of such final brief blank and comprising aligned opposite end portions and, between the latter, a waisted portion of substantially reduced diameter to form a narrowed crotch, the coursewise constriction constituting the waisting resulting from incorporation into the tubular blank of contrasting yarns of respectively different types and deniers and variation of the stitch.

7. A preliminary seamless knitted tubular blank capable of being slit by straight cuts and opened out into a final brief blank of flat form, said tubular blank being of half the width of such final brief blank and comprising two circularly knitted tubular portions extending relatively at an angle and connected by an interposed elbow-like pouch on to the point of which is integrally knitted a comparatively narrow selvedged loop of uniform width destined to provide crotch fabric.

* * * * *